United States Patent [19]

Wong

[11] Patent Number: 4,919,318

[45] Date of Patent: Apr. 24, 1990

[54] SWING ARM ROLLER SPEED DIFFERENTIAL WEB TRACKING SYSTEM

[75] Inventor: Lam F. Wong, Walworth, N.Y.

[73] Assignee: Xerox Corporation, Stamford, Conn.

[21] Appl. No.: 182,620

[22] Filed: Apr. 18, 1988

[51] Int. Cl.[5] ..... B65H 23/038; B65H 23/00

[52] U.S. Cl. ..... 226/17; 242/57.1; 271/250

[58] Field of Search ..... 226/17, 21, 33, 43, 226/27, 83, 134; 242/57.1; 271/227, 236, 245, 246, 248, 250, 265, 266

[56] References Cited

U.S. PATENT DOCUMENTS

| | | | |
|---|---|---|---|
| 3,368,726 | 2/1968 | Funk et al. | 226/17 |
| 4,179,117 | 12/1979 | Rhodes, Jr. | 271/251 |
| 4,200,246 | 4/1980 | Schneider et al. | 242/57.1 X |
| 4,257,587 | 3/1981 | Smith | 271/236 |
| 4,285,512 | 8/1981 | Shlatz | 271/233 |
| 4,411,418 | 10/1983 | Poehlein | 271/236 |
| 4,462,527 | 7/1984 | Taylor et al. | 226/15 |
| 4,483,530 | 11/1984 | Spencer et al. | 271/236 |
| 4,526,309 | 7/1985 | Taylor et al. | 271/236 X |
| 4,621,801 | 11/1986 | Sanchez | 271/251 |

FOREIGN PATENT DOCUMENTS 2171395 8/1986 United Kingdom .

*Primary Examiner*—Donald Watkins

[57] ABSTRACT

Side registration is provided for a web during its forward movement by lateral movement of the web causing one side edge of the web to engage a registration edge guide, by moving the web sideways with self-skewed pivotal rollers engaging and driving the web at their nip. Two separate roller drive systems with a slight speed differential are utilized in cooperation acting on the same web. A downstream, fixed nip, non-slip, roller drive system drives the sheet in its primary direction of movement, at a first driving velocity. Simultaneously, the same web is driven at an upstream position by a pivotal nip drive roller system. This upstream (pivotal nip) roller system is mounted on a pivot arm to pivot therewith, and is driven at a second driving velocity which is slightly lower than the first driving velocity of the other, downstream, roller drive system. This pivotal drive roller system self-pivots downstream into an equilibrium nip position wherein the nip is at a small angle to the side registration edge guide and has a resultant slip velocity frictional lateral force. That lateral force pulls the web sideways towards the side registration edge in proportion to the angle of the pivotal nip resulted from the slight difference between the two nip driving velocities.

1 Claim, 3 Drawing Sheets

SWING ARM ROLLER SPEED DIFFERENTIAL WEB TRACKING SYSTEM

Cross-reference is made to a copending application by the same assignee and inventor entitled "Side Edge Registration System" filed Apr. 18, 1988, U.S. Ser. No. 182,699 (D/88006) now U.S. Pat. No. 4,836,527; and to another copending application by the same assignee, U.S. Ser. No. 171,262 filed Mar. 21, 1988 by Michael A. Malachowski, (D/87196) now U.S. Pat. No. 4,809,968 issued Mar. 7, 1989. The latter is incorporated by reference, especially for the localized corrugation edge guide, which may be utilized with the system herein.

There is disclosed herein a system for side registration of a web such as a computer form fanfold web or the like, or other elongated sheet, by driving the sheet sideways (transversely to the normal or primary sheet path direction of movement) against a side registration edge guide with a controlled force while also simultaneously positively driving the web downstream in its primary direction of movement.

The present invention relates to improved side registration of webs of varying thickness, stiffness or weight, particularly in a copier or printer. Side or lateral edge registration alignment and deskewing may be accomplished without stopping the forward movement of the sheet. Active forward feeding assistance is provided. Wide tolerances or latitude for different sheets, reduced wear, better regulated forces acting on the sheet, and other advantages may be provided.

In the system disclosed herein, side edge alignment of a web against a side edge alignment guide is effected using two driving systems, one of which is a non-crossed, driven, feeding roller nip system on a pivotal arm unit placing the nip in a particular position for providing improved side registration.

Other features of the system disclosed herein include a high ratio of forward driving force on the sheet relative to the side force exerted on the sheet, yet sufficient side force to positively register and deskew the sheet against a side registration edge or guide. A related feature is that the present system resists sheet edge damage from uncontrolled side edge forces. A further related feature is that the side edge registration forces are adjustable and self-regulating.

In the embodiment disclosed herein, two separate roller drive systems with a slight speed differential are utilized acting in cooperation on the same web. A downstream, fixed nip, roller drive system drives the sheet in its primary direction of movement, at a first driving velocity. Simultaneously, the same web is driven at an upstream position by a pivotal nip drive roller system. This upstream roller system is mounted on a pivot arm to pivot therewith, and is driven at a second driving velocity which is slightly lower than the first driving velocity of the other, downstream, roller drive system. This upstream pivotal drive roller system self-pivots downstream into an equilibrium nip position wherein the nip is at an angle to the side registration edge guide and has a resultant slip velocity frictional lateral force. That lateral force pulls the web sideways towards the side registration edge in proportion to the slight difference between the two nip driving velocities.

Preferably, the downstream fixed nip roller drive system is a non-slip, higher normal force, constant speed drive, whereas the upstream drive roller system has a lower normal force for sideways slip, and with a constant but lower velocity. However, it is important to note that the upstream, pivotal, drive roller system is not a passive or drag system. It is positively driven, but the driven speed at that nip is lower than the speed at the other nip, of the downstream drive roller system. The slip in that upstream nip is a relatively small proportion of the total velocity, and is only that which is sufficient to provide for side registration, and is a function of the slight but preferably constant difference in the drive velocity between the two nips. That is, both the equilibrium angle of the pivotal drive and the amount of slip is preferably relatively constant during normal operation with this system on a continuous web segment.

As to registering individual sheets, the following references disclose alignment rolls pivotable between angled and aligned positions, spring loaded toward the angled position, and moveable toward the aligned position in response to the reaction force of a sheet against the registration edge bar:

| | |
|---|---|
| U.S. Pat. No. 3,148,877 Brearley | IBM T.D.B. Vol. 15,No. 4 |
| U.S. Pat. No. 3,175,824 Albosta | IBM T.D.B. Vol. 22,No.11 |
| U.S. Pat. No. 4,505,471 Stockbruger et al | 61-2642 Japan |

Other U.S. Patent references of background interest include: 4,266,762 to Kramer et al; 4,483,530 to Spencer et al; and 4,579,444 to Pinckney et al.

An experimental embodiment has been experimentally verified. The system has demonstrated wide latitude in paper web materials which may be fed and registered. It is a low cost system that can be used for positively feeding computer forms or other continuous paper webs.

The system disclosed herein is particularly suited for the side registration and positive driving of webs to be copied in a copier or printer. It can be used for the side registration and positive feeding of original documents, particularly preprinted computer form web to be imaged on the platen of a copier. Other alternative applications for web feeding and lateral positional control may also be contemplated, such as edge steering of a photoreceptor belt in a copier, or other web or belt tracking applications.

Another advantage of the present system is that since it is a frictional, but positive, drive system it can feed CF or other web without a sprocket drive, and be self-threading. Furthermore, since at least one non-slip nip is provided, an electromechanical servo or other expensive drive system is not required to maintain registration or timing.

By way of background as to prior art systems for lateral registration of computer form web documents for copying, there is noted U.S. Pat. No. 4,462,527 issued July 31, 1984 to T. N. Taylor et al (D/82108) and references cited therein. Also of particular interest is a U.K. patent application GB 2 171 395 A, published 28 Aug. 1986, to David Steele, et al. However that is a system employing an undriven self-castering idler drag wheel, moving between angular extremes, controlled by stops. Other references are U.S. Pat. Nos. 4,179,117; 4,257,587; 4,285,512; 4,411,418; 4,483,530; and 4,621,801. Various cross-roller or swing arm roller side registration systems are disclosed therein. Also various of these patents, such as 4,621,801 and 4,111,418, set forth various difficulties and problems in sheet edge registration.

Further by way of background, a registration system for original sheet documents, in which nipped crossed-rollers with opposing skews are used for side registration into an edge guide in a document path is disclosed in U.S.-A- Pat. No. 4,621,801 issued Nov. 11, 1986 to Hector J. Sanchez, incorporated by reference. Note especially column 17, lines 3–29. Relatively skewed cross-roll side edge registration is known in the art from said U.S.-A-4,621,801 and other references cited therein such as IBM U.S-A-4,316,667 issued Feb. 23, 1982 to E. G. Edwards et al; 4,432,541 issued Feb. 21, 1984 to W. D. Clark et al; and 4,179,117 issued Dec. 18, 1979 to J. H. Rhodes, Jr.

However, such cross-rolled edge registration systems are quite critical as to the inherent delicate balancing of forces acting on the sheet, and the forces which the sheet can tolerate without loss of control or excess roll nip slippage, since the driving force system in the nip is normally designed to allow roller slippage in the direction of movement toward the registration edge after the copy sheet engages the registration edge without undesired or uncontrolled wrinkling or buckling of the sheet. That is especially difficult when lightweight sheets are being fed they require a low driving force to avoid these problems. On the other hand, when heavier weight or thicker sheets are being fed, a higher driving force may be required to overcome higher drag forces caused by sheet edge curl or other sheet feeding resistances.

Thus, there is a problem with cross-roll edge registration systems, in particular, in that the high normal forces and drive forces needed to register heavy paper tend to overstress lightweight papers, which can even lead to sheet damage such as creasing, and or jamming of the sheets in the registration system, particularly if there is an additional problem of preexisting curl on the edge of the sheet.

In contrast to prior art cross-roll systems, in the present system there is produced a small self-controlled side force without the frictional roller slippage and wear of cross-rolls.

Preferably, in the disclosed system, two rollers are acting on the opposite sides of the sheet being registered, and they are rotating in a common or parallel plane, perpendicular the sheet, rather than crossed or skewed relative to one another. That is, preferably the axies of the two rollers are parallel and horizontal and in a single common vertical plane.

It is important to note that in the system embodiment disclosed herein, that there is no drag force component resisting the forward movement of the sheet. That is, the system here does not resist the forward feeding of the sheet, in fact, feeding forward is positively assisted. The disclosed system is an active, positively driven system, in which the rollers are acting to assist in the driving of the sheet in its forward, primary, direction of movement, rather than having any forward direction drag effect on the sheet. The only drag force component acting on the sheet here is purely perpendicular the forward feeding direction, directly toward the edge guide. When there is no sheet present in the system, there is no slip, if a nip pair is utilized as shown. The only friction is between the web itself and the elements of the deskewing system. There is no wear-inducing slip between the two rollers forming the side registration roller pair. This is in contrast to a conventional cross roller edge registration system and other art noted herein wherein the drive roll is constantly slipping against an idler roller or another surface at a skewed angle thereto, even when no sheet is present in the nip.

Another feature of this system shown herein is that although it automatically operates to automatically change the driving angle of the pivotal roller drive nip relative to the paper, no sensors or electrical controls are required, and a simple, low cost mechanism is provided. As shown in the exemplary embodiment disclosed herein, both mating rollers may be mounted and rotated on a single common dual arm pivotal member, which arm unit member pivots relative the sheet being registered, and relative to the side guide, to self-adjust the driving position and angle of the rollers.

Another feature is that the present system may be utilized either with the sheet in a planar configuration, or while the sheet is curved, as in the sheet inverting path of a document handler.

As xerographic and other copies increase in speed, and become more automatic, it is increasingly important to provide higher speed yet more reliable and more automatic handling, feeding and registration of both the copy sheets and the "originals" (the document sheets being copied). It is desirable to feed and accurately register sheets of a variety of mixture of sizes, types, weights, materials, conditions and susceptibility to damage, yet with minimal jamming, time delays, wear or damage by the sheet transporting and registration apparatus, even if the same sheets are automatically fed and registered repeatedly, as for recirculating document precollation copying.

The "document" here is the sheet (original or previous copy) being copied in the copier onto the "copy sheet", or "copy". In the description herein the term "document" or "sheet" refers to a usually filmsy sheet of paper, plastic, or other such conventional individual image substrate, and not to microfilm or electronic images which are generally much easier and faster to manipulate and reorder. However, the copy sheet can be generated from electronic or other image data other than a document sheet.

The present invention, which is claimed in the appended claims, overcomes various of the above-discussed and other problems, and provides various of the above noted features and advantages.

A specific feature of the embodiment disclosed herein is to provide in a system for side registration of an elongated delicate or flimsey web sheet by driving the sheet sideways (transversely) in the sheet path against a side registration edge guide, while the sheet is being driven downstream in its primary direction of movement, by a frictional roller drive system, the improvement comprising:

downstream fixed nip roller drive means for engaging and driving the sheet in said primary direction of movement, at a first driving velocity;

upstream pivotal nip drive roller means mounted on a pivotal arm unit to simultaneously engage and drive the same sheet upstream of said downstream fixed nip roller drive means;

means for driving said upstream pivotal nip drive roller means at a second driving velocity which is slightly less than said first driving velocity of said downstream fixed nip roller drive means such that said pivotal nip drive roller means pivots with said pivotal arm unit into an equilibrium nip position at an angle to said side registration edge guide with a resultant slip velocity frictional force pulling the sheet towards said side registration edge guide proportional to said angle of the pivotal nip resulting from said slight difference between said first and second driving velocities.

Further features provided by the system disclosed herein, individually or in combination, include, in a method of side registration and deskewing a web by driving the web sideways (transversely) in the web path against a side registration edge guide, while the web is being driven downstream in its primary direction of movement by a roller drive system, the improvement comprising:

engaging said driving the web in said primary direction of movement at a first nip driving velocity with a downstream fixed nip roller drive;

simultaneously engaging the same web upstream with a second, upstream, pivotal, nip roller drive on a pivotal arm unit;

driving said upstream pivotal nip roller drive at a second nip driving velocity which is slightly lower than said first nip driving velocity of said downstream fixed nip roller drive;

and pivoting automatically said pivotal nip roller drive with said pivotal arm unit into an equilibrium nip position at an angle to said side registration edge guide with a resultant slip velocity frictional force pulling the web towards said side registration edge guide proportional to said angle of said pivotal nip and resulting from said slight difference between said first and second nip driving velocities.

wherein said first and second nip driving velocities are constant velocities and said upstream pivotal nip roller drive is driven at a constant, but lower, speed than said downstream fixed nip roller drive;

wherein the ratio of said first and second nip driving velocities is between approximately 1.002 and 1.015 and said angle of said pivotal nip roller drive to said registration edge guide is between approximately 80 degrees and 86 degrees; and/or wherein said arm unit is freely pivotable in a preset maximum pivotal range limited to approximately 10 degrees, said limited range being defined by limit means positioned to impede pivoting of said arm unit outside of said limited range.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale), wherein.

In this apparatus for side registering a web sheet to a registration edge guide during foward movement of the sheet, the sheet is driven along a path with a forward direction of movement and a lateral direction of movement substantially normal to said forward direction, with the lateral movement of the sheet causing one side edge of the sheet to engage said registration edge guide so as to be aligned thereby. The means for moving the sheet comprises rollers providing at least two spaced sheet engaging and driving nips between a driving roller and an idler roller, preferably adjacent the registration edge guide. The downstream driving nip is fixed (non-rotating and non-skewing) and non-slip, and the upstream nip is pivotable and slower.

There is shown in FIGS. 1–7 an exemplary side registration and deskewing system 10. In this system 10 an incoming web sheet 12 is positively driven in a primary, downstream, direction 14 indicated by the large movement arrows, but is also side registered and deskewed in the transverse direction against a side registration edge guide 16. (This example 16 is shown in cross-section in FIG. 4.)

Figure 6:
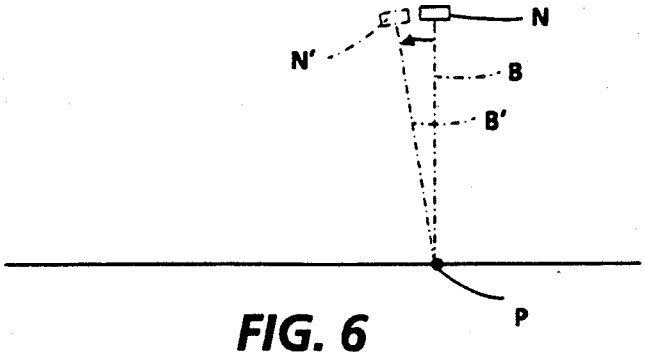
FIG. 6 is a schematic kinematic representation (geometric layout) of the system of FIGS. 1–5 to the scale and proportions of FIGS. 1–3.

The system 10 here first includes an upstream pivotal roller drive system in which a driven drive or feed roller 18 mates with an idler roller 19 to form a first pivotable, driving nip 20 (identified as "N" and "N" in the kinematic layout of FIG. 6.) Both rollers 18 and 19 pivot together, by the same amount, and only with an arm unit 26 on which they are both mounted. The arm unit 26 is freely pivotal between maximum and minimum position stops 32 and 34, i.e. between the limit positions shown (represented by the unprimed and primed indicia positions in FIG. 6). In FIG. 6 "P" is the pivot axis and "B" is the effective pivoting arm length to the nip N. The rollers 18, 19 rotate in the same plane and on parallel axies. They are not skewed relative to one another. They are respectively rotatably mounted on an upper arm 22 and lower arm 24 of the integral pivotable arm unit 26. The arm unit 26 is rotatably mounted about a pivot axis 30 (identified as "P" in the kinematic of FIG. 5).

Thus, in the system 10 the upstream pivotal nip drive roller system preferably comprises a mating nip pair of two commonly pivotally mounted and parallel axis rollers 18, 19 which do not slip relative to one another under any normal circumstances. This can be provided by two arms 22, 24 integrally connected as a U-shaped arm unit 26, so that one arm 22 may extend over the upper surface of the paper path and the other arm 24 may extend below the paper path, but so that both arms pivot together as a single unit 26. A drive roll 18 may be mounted to the end of one such arm and an idler roll 19 to the end of the other arm, defining a nip 20 therebetween for grasping the sheet 12 at the self-stabilizing angle described herein.

If desired, the pivotal arm unit 26 may be spring biased so that the nip 20 is at an initial position at a minimum limit angle to the sheet edge guide 16. However, this is not required.

The web 12 is preferably closely confined between upper and lower baffle plates 40 and 42 (see FIGS. 4 and 5) except at small apertures 40*a* and 42*a* in the baffles provided only for the rollers 18 and 19 to extend therethrough to engage opposite sides of the sheet 12 over the pivotal range of movement of the nip 20 with the swing of the arm unit 26.

Figure 4:
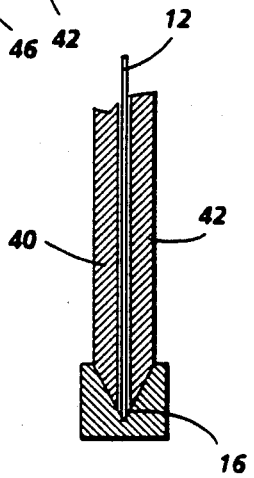
FIG. 4 is an enlarged cross-sectional view along the line 4—4 of FIG. 1, of the exemplary sheet side registration edge guide here (viewed rotated into a vertical orientation)

The edges of the baffles 40, 42 are shown beveled in FIG. 4 to mate with the "V" shaped edge channel of the edge guide 16, but would not need to be, especially if thin gauge sheet metal is used. A known edge guide may be used with this system, which is preferably a "V" or "U" shaped channel or slot along one path edge.

In this system 10, the same web 12 is simultaneously being pulled downstream by a second nip 44, preferably provided by another pair of mating rollers 45. However, the nip 44 of the rollers 45 is fixed parallel the edge guide, and does not pivot, and is driven at a slightly higher sheet feeding speed than the nip 20.

The drive system 50 for the system 10 components preferably comprises a single motor "M". (However, two separate motors can be provided for the roller sheets to the two nips 20, 44 if desired.) Various drives may be utilized. As shown here, the motor M is conventionally mounted on and rotatably driving a fixed shaft 46 driving one of the rollers 45. Through a pulley 56 on the shaft 46 and a belt 60 motor M is also driving a rotatable shaft 52, the arm 22 on which shaft 52 the drive roller 18 is mounted and rotably driven. Shaft 52 is driven by its integral pulley 54. The drive belt 60 may be a conventional elastomer "O" ring. Note that it is not desirable to have an excessive arm biasing spring force, so moment of the arm unit 26 due to the drive system may need to be spring counter-balanced in some other drive systems. However, by using an intermediate drive transmission via a fixed shaft 58 directly over the shaft 52, as shown, there is no pivot moment. The belt 60 drives a pulley 62 on shaft 58, which in turn drives pulley 54 and its shaft 52 through an intermediate belt 64. Thus, no moment is applied thereto by this drive system 50.

The desired speed differential between nips 20, 44 can be provided by a corresponding difference in drive pulley and/or drive roller diameters.

By driving only the top rollers 18, 45, as shown, this system can be used to feed web documents over an underlying platen of a copier or EFE imaging device without smearing the image side of the web, since the web would preferably be face down in that case.

Although not critical, an example of a suitable material for the driven roller 18 may desirably be a rounded or crowned-edge polyurethane rimmed wheel, for example. The idler roller 19 maybe Lexan plastic, or steel, with a smooth cylindrical outer surface. Similar rollers may be used for the rollers 45.

As noted both rollers 18, 19 are on a single, two part, arm unit 26 and are free to commonly pivot about a common vertical pivot axis 30 which is perpendicular the sheet path. This arm unit 26 preferably has a relatively low mass, but that is not critical to this system.

The downstream, fixed nip, roller drive system also preferably comprises only a single roller pair 45 nip 44 acting on the sheet, as this will allow easier web 12 rotation. As shown, preferably this is a conventional roller nip fixed by the respective rollers 45 being on rotating fixed shafts 46 always perpendicular the side registration edge 16. This is in contrast to the upstream pivotal nip 20 system, in which the rollers 18, 19 are mounted on and rotate perpendicularly to a pivotal arm unit 26 which arm unit is extending approximately perpendicular the edge guide from a pivot axis 30 such that this pivoted roller nip 20 is pivotable from a position substantially parallel the registration edge guide to a position at small angle thereto, i.e. the arm unit 26 is pivotal slightly downstream, in the direction towards the fixed nip 44.

Note that some side slip is required in the downstream fixed nip 44 so that an initially mis-registered web 12 may be moved sideways in this nip. It has been found that sufficient such lateral slip can be provided in a conventional nip 44 which does not normally allow slip in the primary feeding direction. The small lateral slip needed can be provided slowly, over several revolutions of the roller 45, under the steady sideways urging of the upstream, skewed, nip 20. This downstream nip 44 may be a single crowned urethane driver upper roller against a low friction and smooth idler lower roller, like the nip 20.

To avoid a relative moment on the web 12 which could cause an undesired rotational moment, preferably both nips 20, 44 are approximately in line along the web path, i.e. substantially the same transverse distance from the path edge guide 16. The upstream nip 20 is preferably relatively close to the edge guide 16 to resist sheet buckling therebetween from the sideways force of this nip, so therefore both nips preferably are.

As noted, stop limits 32, 34 are desirably provided to restrict the range of pivotal movement allowed for the arm unit 26, and therefore the nip 20, of the upstream system. That nip 20 should not be allowed to pivot upstream, as otherwise it could reject the front edge of a web being loaded rather than positively feeding it forward (downstream). This calls for an outer pivotal limit 32 where the arm axis is are approximately perpendicular the edge guide. An inner pivotal limit 34 desirably prevents the nip from initially or subsequently forming too large a downstream angle towards the edge guide, which could cause too large a drag (tensioning) force on the web.

Preferably, the ratio of the nip 44, 20 driving velocities is between approximately 1.002 and 1.015. The operating angle of the pivotal nip N roller 18 drive axis B to the registration edge 16 guide is preferably between approximately 80 degrees and approximately 86 degrees, i.e. from the nip 20 being approximately parallel the edge guide 16 to about 10 degrees skewed thereto. Preferably, the limit 34 should prevent the roller 18 axis from being angled more than 8–10 degrees towards the side guide. The preferred maximum free swing pivot angles of the arm unit 20 between stop limits 32, 34 is to pivot the nip between about 85 to 87 degrees to the side guide. See the difference between the solid and dashed line positions in FIG. 1, and the difference between the prime and unprime positions in FIG. 5.

Figure 1:
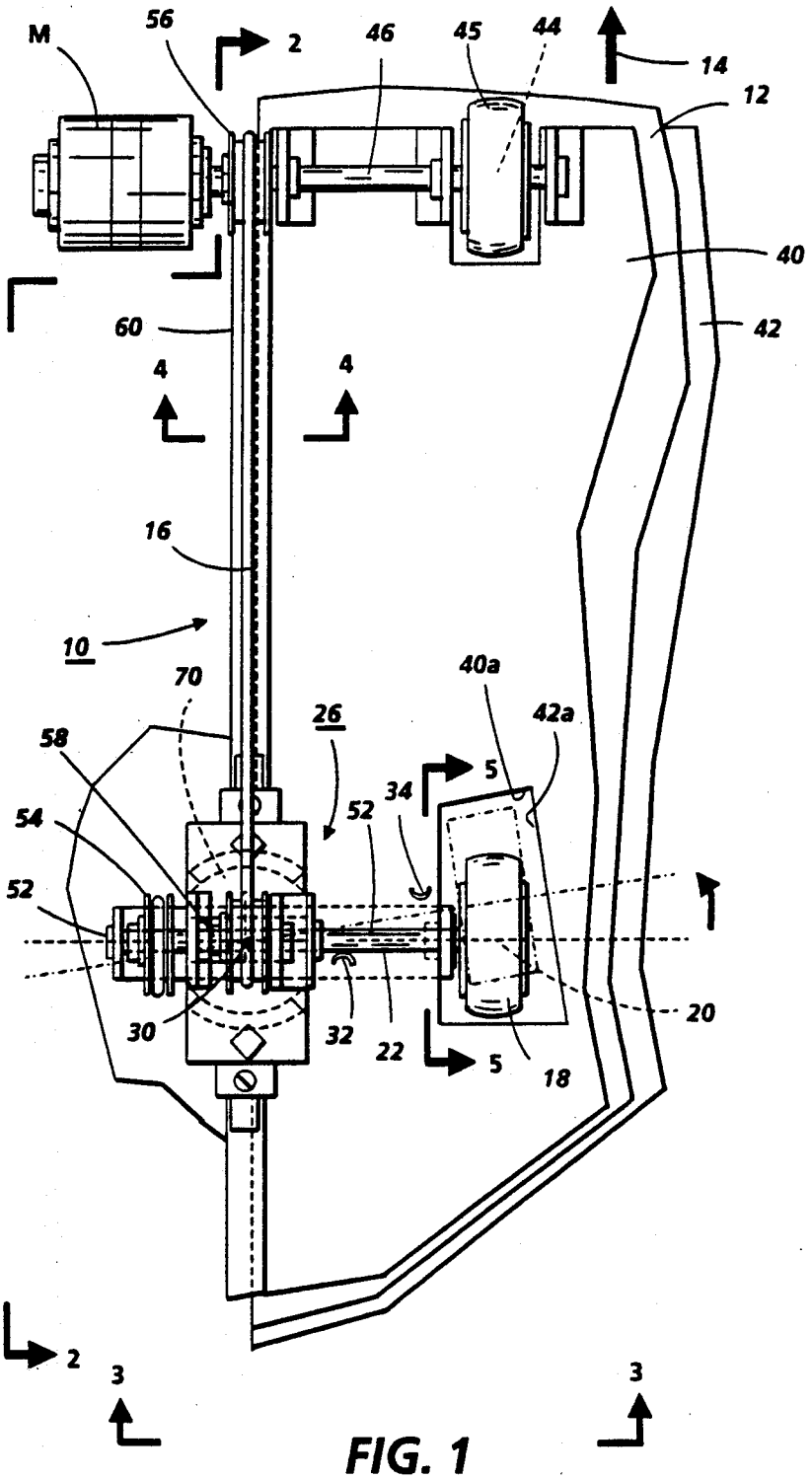
FIG. 1 is a top view of one side registration and deskewing system example of the invention.
Figure 7:
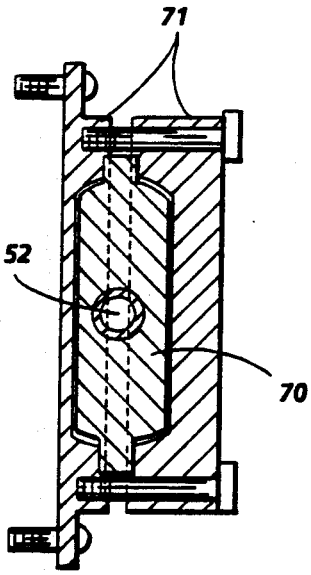
FIG. 7 is an enlarged cross-sectional view of the pivotal bearing of the system of FIGS. 1–6 taken through the pivot axis.
Figure 2:
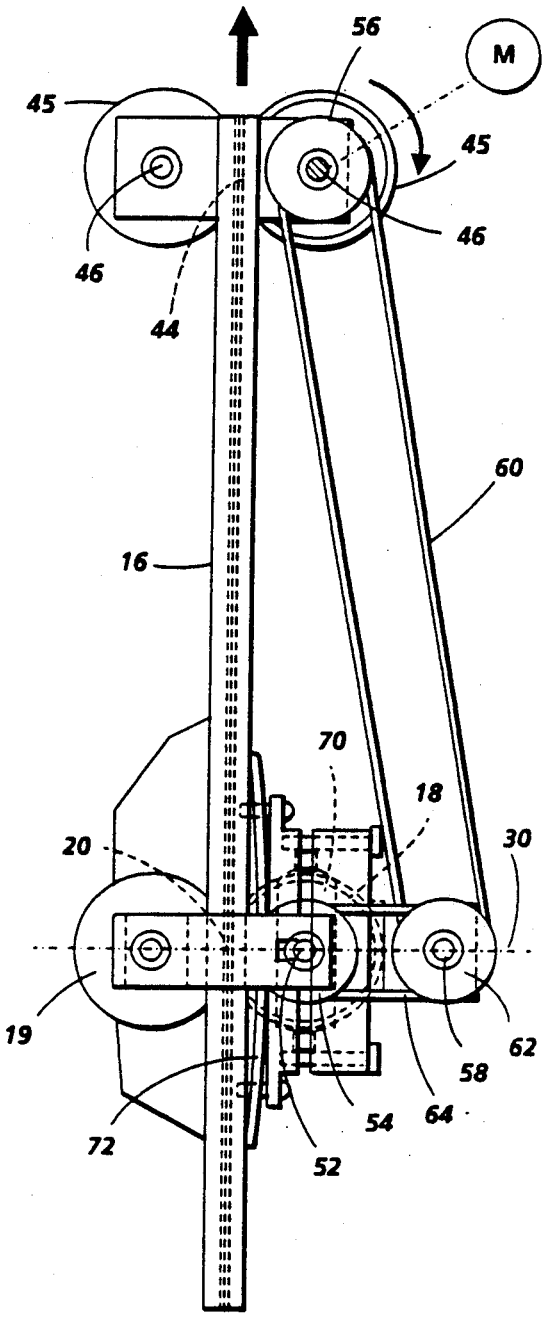
FIG. 2 is a side view of the exemplary system of FIG. 1, to the same scale and proportions; taken along the line 2—2 of FIG. 1.
Figure 3:
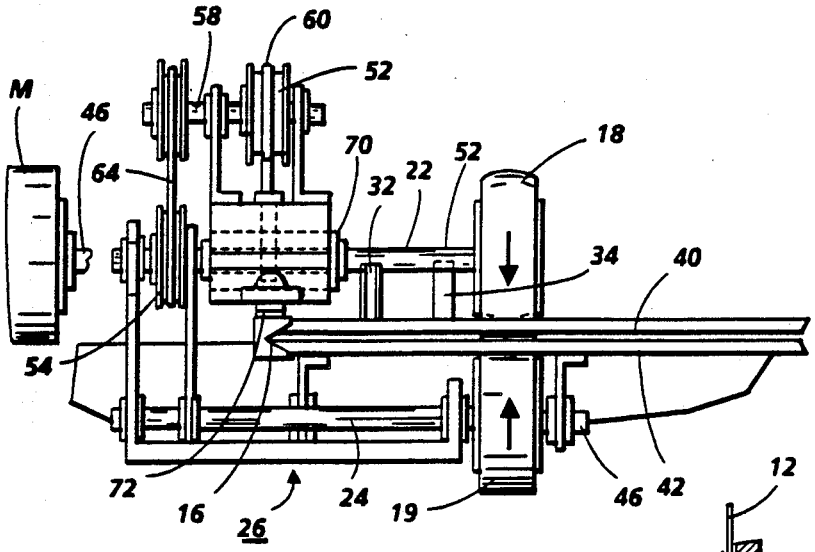
FIG. 3 is a front view taken along the line 3—3 of FIG. 1.
Figure 5:
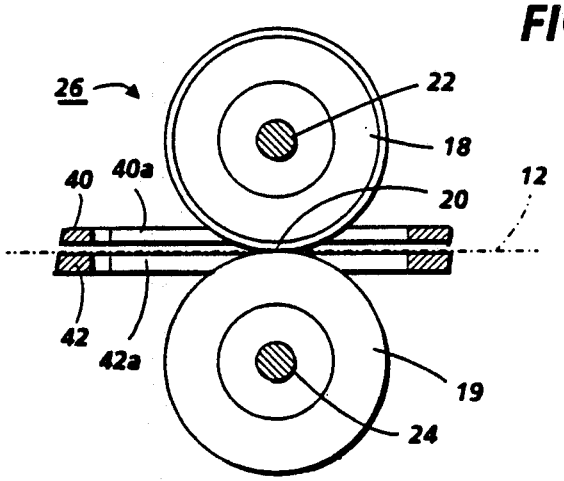
FIG. 5 is an enlarged side view along the line 5—5 of FIG. 1, of the exemplary deskewing pivotal roller system nip.

One example of a pivotal mounting of the arm unit 26 which allows the driving roller 18 to be driven from the same motor M as the downstream rollers 45 is illustrated herein, and others will be apparent from mechanical engineering principles. As shown in FIG. 7, in this example the upper arm 22 roller 18 is driven by rotation of its mounting shaft 52 while that shaft is passing through a horizontally rotatable bearing 70. The generally cylindrical bearing 70 is retained in a retainer 71 fastened to the side guide 16. Bearing 70 is rotatable about the axis 30 but is precluded from vertical movement. There is also shown a roller normal force screw adjustment of the upper arm 22 against a leaf spring 72, as shown especially in FIG. 2.

Because the shaft 58 is driven from pulley 62 directly overhead, rather than from the side, the tension of the connecting driving belt 64 is resisted by said single axis bearing 70, and. the drive system 50 does not effect the free horizontal rotation of the arm unit 26.

The lower arm assembly 24 here in this example is connected to shaft 52, as shown, and/or bearing 70, to pivot about axis 30 integrally with the upper arm 22. The elements of the lower arm 24 can be integral, since the lower arm need not provide a rotatable shift, since its roller 19 here is an idler.

Although not illustrated herein, if an additional such roller system or unit 10, or a conventional cross roll, is provided upstream from the nip 20 by less than the sheet dimension in the feeding direction, so that both nips can act on the sheet simultaneously for part of the sheet movement, as disclosed in the above-cited copending incorporated Michael A. Malachowski application D/87196, then a greater initial sheet misregistration can be corrected. This upstream nip may also be spaced further away from the side registration edge, to capture more grossly misregistered sheets entering the system, i.e. sheets whose edges are initially further away from the registration edge.

Preferably the upstream feed path is such that if there is any initial skew of the sheet it is a skew such that the rear or upstream edge of the sheet will hit the side edge guide before the front corner of the sheet does. This avoids buckling or jamming tendencies which can be caused by the front corner of the sheets snubbing against the side registration edge. This path orientation can be provided in a known manner, such as by using a slightly larger diameter for the inside feed roll versus the outside rollers of conventional common shaft feed rollers upstream of the registration system, or by appropriate acceleration of the sheet being fed into the registration system.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a system for side registration of an elongated delicate or flimsy web sheet by driving the web sideways (transversely) in the sheet path against a side registration edge guide, while the web is being driven downstream in its primary direction of movement, by a frictional roller drive system, the improvement comprising:

downstream fixed nip roller drive means for engaging and driving the web in said primary direction of movement, at a first driving nip velocity;

upstream pivotal nip drive roller means mounted on a pivotal arm unit to simultaneously continously engage and drive the same web upstream of said downstream fixed nip roller drive means;

means for driving said upstream pivotal nip drive roller means at a second driving nip velocity which is slightly less than said first driving nip velocity of said downstream fixed nip roller drive means by a ratio of said first and second driving velocities between approximately 1.002 and 1.015;

said pivotal nip drive roller means automatically pivoting with said pivotal arm unit into an equilibrium nip position at a small, variable, angle to said side registration edge guide, with a resultant slip velocity frictional force pulling the web towards said side registration edge guide which is proportional to said equilibrium angle, which is proportional to and resulting from said slight difference between said first and second driving nip velocities, to deskew the web by driving the web sideways (transversely of) the web path against said side registration edge guide;

wherein said web sheet is a computer form web;

wherein said upstream pivotal nip drive roller means comprises a constantly mating nip of two parallel axis rollers, mounted to said pivotal arm unit to pivot therewith, which rollers do not slip relative to one another;

and wherein said pivotal arm unit is freely pivotable in a preset maximum range of pivotal movement limited to approximately 10 degrees, said limited range of pivotal movement being defined by limit means positioned to impede pivoting of said arm unit outside of said limited range.

* * * * *